US006186690B1

(12) United States Patent
Duncan

(10) Patent No.: US 6,186,690 B1
(45) Date of Patent: Feb. 13, 2001

(54) STRAP CONNECTION SYSTEM

(75) Inventor: Daniel D. Duncan, Galax, VA (US)

(73) Assignee: Napco, Inc., Sparta, NC (US)

( * ) Notice: Under 35 U.S.C. 154(b), the term of this patent shall be extended for 0 days.

(21) Appl. No.: 09/185,159

(22) Filed: Nov. 3, 1998

(51) Int. Cl.[7] ..... B42F 13/02

(52) U.S. Cl. ..... 402/8; 281/21.1; 281/45; 402/70

(58) Field of Search ..... 281/21.1, 38, 45, 281/46, 47; 402/50, 8, 70, 73

(56) References Cited

U.S. PATENT DOCUMENTS

| | | | | |
|---|---|---|---|---|
| 277,490 | | 2/1883 | Wenstrom et al. . | |
| 278,352 | | 4/1883 | Wenstrom et al. . | |
| D. 344,455 | | 2/1994 | Kornberg et al. . | |
| 1,906,661 | * | 5/1933 | Seibert | 281/47 |
| 3,596,928 | * | 8/1971 | Edmonds | 281/46 |
| 3,620,882 | | 11/1971 | Chou et al. . | |
| 3,735,516 | | 5/1973 | Wenstrom . | |
| 3,752,503 | | 8/1973 | Holes et al. . | |
| 3,797,146 | | 3/1974 | Holes . | |
| 4,172,332 | | 10/1979 | Holes et al. . | |
| 4,462,854 | | 7/1984 | Wenstrom et al. . | |
| 4,702,026 | | 10/1987 | Shaine . | |
| 4,986,864 | | 1/1991 | Heim et al. . | |
| 5,248,037 | | 9/1993 | Kornberg et al. . | |
| 5,445,417 | * | 8/1995 | Bromer et al. | 281/31 |
| 5,573,276 | * | 11/1996 | Nomura et al. | 281/45 |
| 5,595,401 | * | 1/1997 | Exline et al. | 281/2 |
| 5,620,206 | * | 4/1997 | Flores | 281/21.1 |

* cited by examiner

*Primary Examiner*—Daniel W. Howell
*Assistant Examiner*—Monica S. Carter
(74) *Attorney, Agent, or Firm*—Kennedy Covington Lobdell & Hickman LLP

(57) ABSTRACT

An improved strap connection system for releasably binding pages together within covers in a lay flat condition including a pair of cover pieces and a strap having one end anchored to one cover piece, the other end extending away from the cover piece and an arrangement for releasably securing the extending end of the strap to the other cover piece. In a preferred embodiment, the improved strap connection system is utilized in an album including a front album cover, a rear album cover and a pair of flexible strap members with one end fixedly secured to the rear cover and with the other end extending away from the rear cover. The arrangement for releasably securing the extending ends of the strap members preferably comprises a retaining sheet attached to and forming a pocket with the front cover and the extending ends may include a textured surface for frictionally retaining the ends within the pocket. In use, the extending ends of the strap members are inserted through openings formed in the end of the album pages and slide under the retaining sheet into the pocket to secure the strap members in place for securely holding the album pages together within the covers while allowing a user to easily remove, rearrange or add pages to the album.

16 Claims, 7 Drawing Sheets

STRAP CONNECTION SYSTEM

BACKGROUND OF THE INVENTION

The present invention relates generally to binding devices and, more particularly, to an improved strap connection system for releasably binding pages together within covers in a lay flat condition.

The first known Latin manuscript, circa 55 A.D. was protected by two wooden covers bound on one side by leather thongs to act as a hinge. Today, there are many different types of binding systems. One type of hardback binding is an adhesive binding using glue with an integral cover to permanently secure the pages within the cover. While adhesive bindings are used for permanently binding the pages of books, there are many other types of less permanent and less expensive binding systems which serve the basic needs of protecting, storing and providing convenient access to the bound information.

Perhaps the best known non-permanent binding system is the three ring binder. The three ring binder is available in a variety of different sizes ranging from one inch to five inches for holding various numbers of pages therein. The rings may be round, D-shaped or elliptical rings and are opened and closed for adding, removing and rearranging pages. One disadvantage of a three ring binder is that the size of each binder is fixed and it is not reducable or expandable to accommodate varying number of pages therein. Thus, the user may select a binder which is too large or too small for the number of pages to be held by the rings of the binder. If the number of pages exceeds the capacity of the rings, the rings may not close properly and the pages may be difficult to turn or may become loose. If the number of pages is less than the capacity of the rings, then the user may be left with a bulky binding system having exposed rings. In either case, the number of pages may increase or decrease as the user adds or removes pages and it may be difficult to select a binder which is sized to match the number of pages held in the binder at any given time. Another disadvantage is that the three ring binder does not typically lay flat in its closed condition and thus may be difficult to store and may be less aesthetically pleasing in both the opened and closed conditions.

Other types of non-permanent binding systems include wire bindings, spiral coil bindings, comb bindings and screw post bindings. Wire bindings and spiral coil bindings require special machinery to punch holes in sheets to be bound and insert the binding through the holes. While these types of bindings are not permanent and are often used to bind reports and presentations, one disadvantage is that pages cannot be easily removed, rearranged or added once they are secured because the binding must be removed and reattached using special machinery. In addition, the size of the wire or spiral coil is fixed so that the number of pages cannot exceed a certain predetermined amount.

Comb binding uses a separate spine to hold together punched pages and allows pages to be added, removed or rearranged. Similarly, screw post binding uses two cover pieces and a removable spine to releasably hold punched pages together. While comb and screw post bindings provide an expandable, lay flat binding system, one disadvantage is these bindings may be too bulky if only a small number of pages are to be bound. In addition, these type of bindings may be relatively expensive due to the three cover pieces and the comb or screw post components which are required. Further, the required disassembly and reassembly of the parts each time a page is removed or added makes these types of bindings relatively complicated and not user-friendly.

With the increasing popularity of showcasing photos and memorabilia in attractive keepsake albums and scrapbooks, the need for lay flat, attractive albums including user-friendly binding systems which allow pages to be removed, rearranged or added with ease has increased. One currently available lay flat, photo album utilizes a binding system which includes straps and two anchored pieces having slots for receiving the straps to releasably secure two covers together. While this binding systems allows the user to remove, rearrange and add pages, as desired, in a lay flat album, one disadvantage is that the straps are difficult to thread through the slots and must be threaded in a certain manner to properly secure the strap. Further, this binding system requires that the two covers be separate. Thus, a separate spine portion must be added if the user desires to cover the binding at the spine of the album resulting in additional expense. Another disadvantage is that the strap ends are exposed at both the front and rear cover. In addition, the straps must be located only where the slots in the anchored pieces are formed and they cannot be moved to different positions along the vertical extent of the covers to accommodate pages having slots in various locations along the edge thereof.

Therefore, there is a need for a simple connection system which securely holds pages together within covers while allowing a user to easily remove, rearrange or add pages.

SUMMARY OF THE INVENTION

The present invention is directed to an improved strap connection system which provides a simple, inexpensive means for releasably securing pages within covers in a lay flat condition. The improved strap connection system includes a pair of cover pieces and a flexible binding strap having one anchored end which is permanently secured to one cover piece, with the other end of the strap extending away from such cover piece. An arrangement for releasably securing the extending end of the strap to the other cover piece includes a retaining sheet attached to and forming a pocket with the other cover piece. In use, the extending end of the strap is inserted through a slot formed in the end of the pages and slides under the retaining sheet into the pocket to secure the strap in place. The improved strap connection system is specifically designed to allow the extending end of the strap to be easily released from and secured to the cover piece for readily removing, rearranging or adding pages while providing a secure connection for holding the pages together within the covers. In addition, the elongated, flexible strap allows a large or small number of pages to be held within the covers, as desired, and permits the cover pieces and pages to be opened or closed into a completely flat condition. The improved strap connection system of the present invention is ideal for use in photo albums, scrapbook albums, report covers, portable CD holders, collector albums and virtually any item for which a 3-ring binder or other releasable-type binder is currently used.

In the preferred embodiment, the improved strap connection system is utilized in an album, such as a scrapbook or photo album, to releasably bind a plurality of album pages together within the album covers. The cover pieces of the connection system are defined by a front album cover and a rear album cover which are joined together by an integral album spine along the inner vertical extent of each cover. Thus, the front and rear covers and spine form a single piece rather than three separate pieces as is required with some binding systems.

In the preferred embodiment, the strap of the album comprises a pair of elongated, flexible strap members selectively placed along the inner vertical extent of the album covers in a spaced apart position and extending therebetween. While the strap comprises two strap members in this embodiment, the strap may include multiple strap members in other embodiments, as desired. For example, additional strap members may be used to provide stability in larger applications, such as by way of example, oversized photo albums may include three strap members. Each strap member has one extending end which is releasably secured to one cover and an opposite anchored end which is fixedly secured to the other cover. In the preferred embodiment, the fixedly secured or anchored end of each strap member comprises a retaining strip, extending between and connecting the strap members, which is securely fastened along the vertical extent of the rear inside cover. While the preferred retaining strip is a plastic strip adhered to the rear inside cover, the strip may be constructed of any suitable material and may be attached to the rear inside cover by any suitable means. The anchored end of each strap member is securely fastened near the inner vertical extent of the rear inside cover by a retaining sheet which is attached to the rear inside cover and overlays the ends of the strap members thus also concealing the strap ends. In the preferred embodiment, the retaining sheet substantially covers the entire inside rear cover. While an adhered anchored strap member end covered by a retaining sheet which is attached to a cover piece is preferred for easy and secure attachment, any other suitable means for securely attaching one end of the strap to a cover piece may be used.

In the preferred embodiment, the retaining sheet for securing the extending ends of the strap members substantially covers the entire inside front cover so that the pocket is formed between the retaining sheet and the front inside cover. The entry to the pocket is preferably positioned along the inner vertical extent of the front inside cover for receiving the extending end of each strap member. In use, the extending ends of the strap are inserted through openings along the left margins of pages and then slide under the retaining sheet into the entry portion of the pocket to releasably bind the pages together. In the preferred embodiment, the extending end of each strap member may be rounded or tapered and may include a textured surface for providing a friction retaining means when the strap member end is inserted into the pocket for providing an exceptionally secure binding.

Therefore, it is an object and feature of the present invention to provide a simple, inexpensive improved strap connection system for releasably binding pages together within covers in a lay flat condition which includes means for easily removing, rearranging or adding pages while providing a secure binding.

It is another object and feature of the present invention to provide a strap connection system including a pair of cover pieces and a strap having one end anchored to one cover piece and the other extending end releasably secured to the other cover piece and including a simple means for releasably securing the extending end of the strap.

It is an additional object and feature of the present invention to provide a strap connection system including a retaining sheet attached to and forming a pocket with one cover piece for releasably securing the extending end of the strap to that cover piece.

It is yet another object and feature of the present invention to provide an album utilizing the improved strap connection system for releasably binding album pages together within a front album cover and a rear album cover and including a pair of strap members, each having one end anchored to one album cover and the other extending end releasably secured to the other album cover and including a simple means for releasably securing the extending ends of the strap members to the album cover.

It is a further object and feature of the present invention to provide a strap connection system including a retaining sheet which forms a pocket with the album cover piece for receiving and releasably securing the extending ends of the strap members therein.

Other objects and features will be readily apparent from the accompanying drawings and description.

DESCRIPTION OF THE PREFERRED EMBODIMENT

Figure 1:
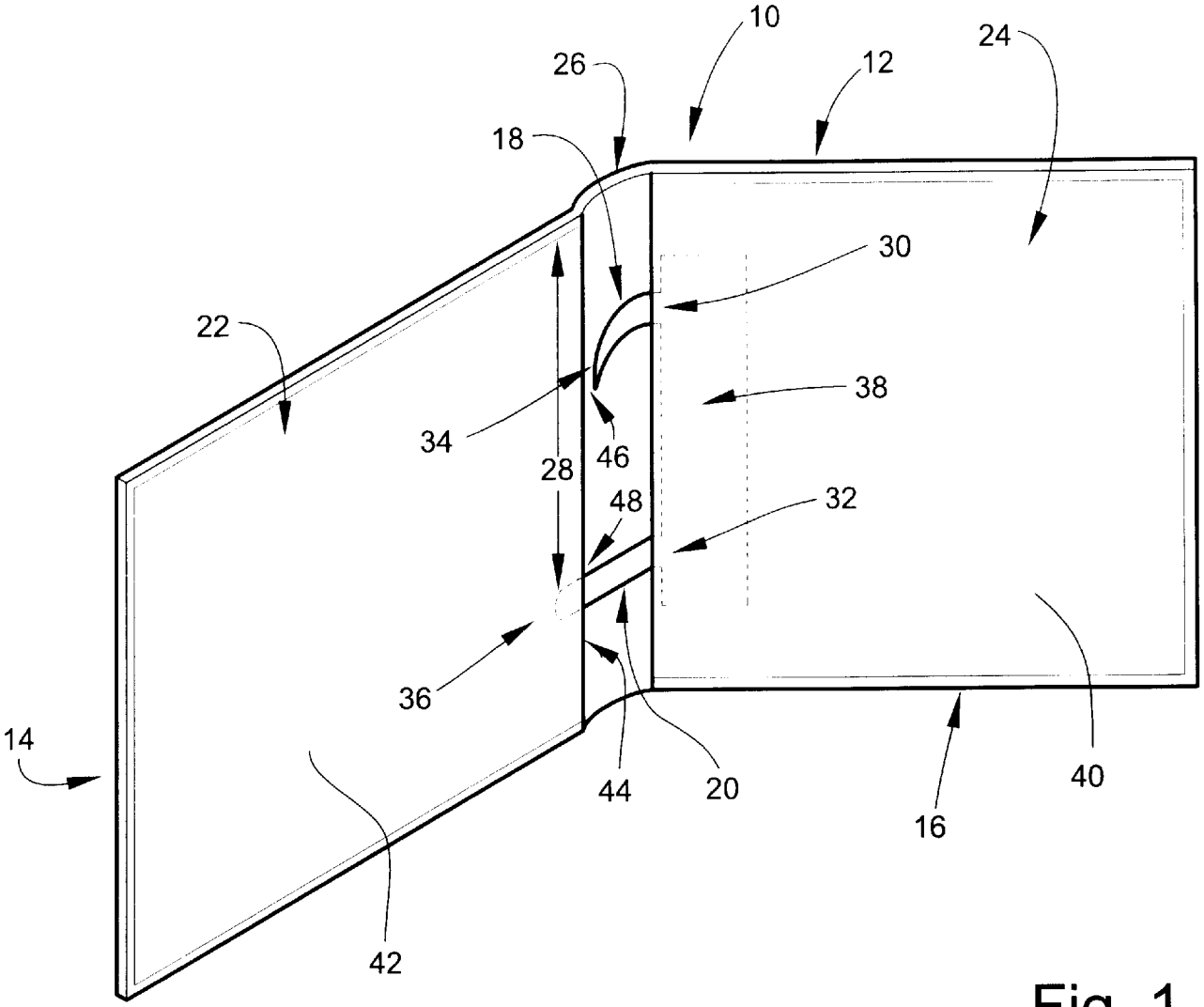
FIG. 1 is a perspective view of one embodiment of the present invention showing an album including the improved strap connection system with the strap members secured in place along the inner vertical extent of the front and rear inside covers.

Looking now in greater detail at the accompanying drawings, FIG. 1 illustrates a strap connection system 10 in a lay flat album 12 including a front cover 14, a rear cover 16, and a pair of flexible strap members 18, 20 for releasably binding a plurality of album pages together within the covers 14, 16. While the present invention has many applications, such as but not limited to, photo albums, scrap book albums, report covers, portable CD holders and collector albums, the description herein will be for a photo album. The front cover 14 and the rear cover 16 each have an outside cover 21, 23 and an inside cover 22, 24, respectively. The front cover 14 and the rear cover 16 of the preferred album 12 are joined together by an integral album spine 26 along an inner vertical extent 28 of each inside cover 22, 24 so that the covers 14, 16 and spine 26 form a single integral cover.

Figure 2:
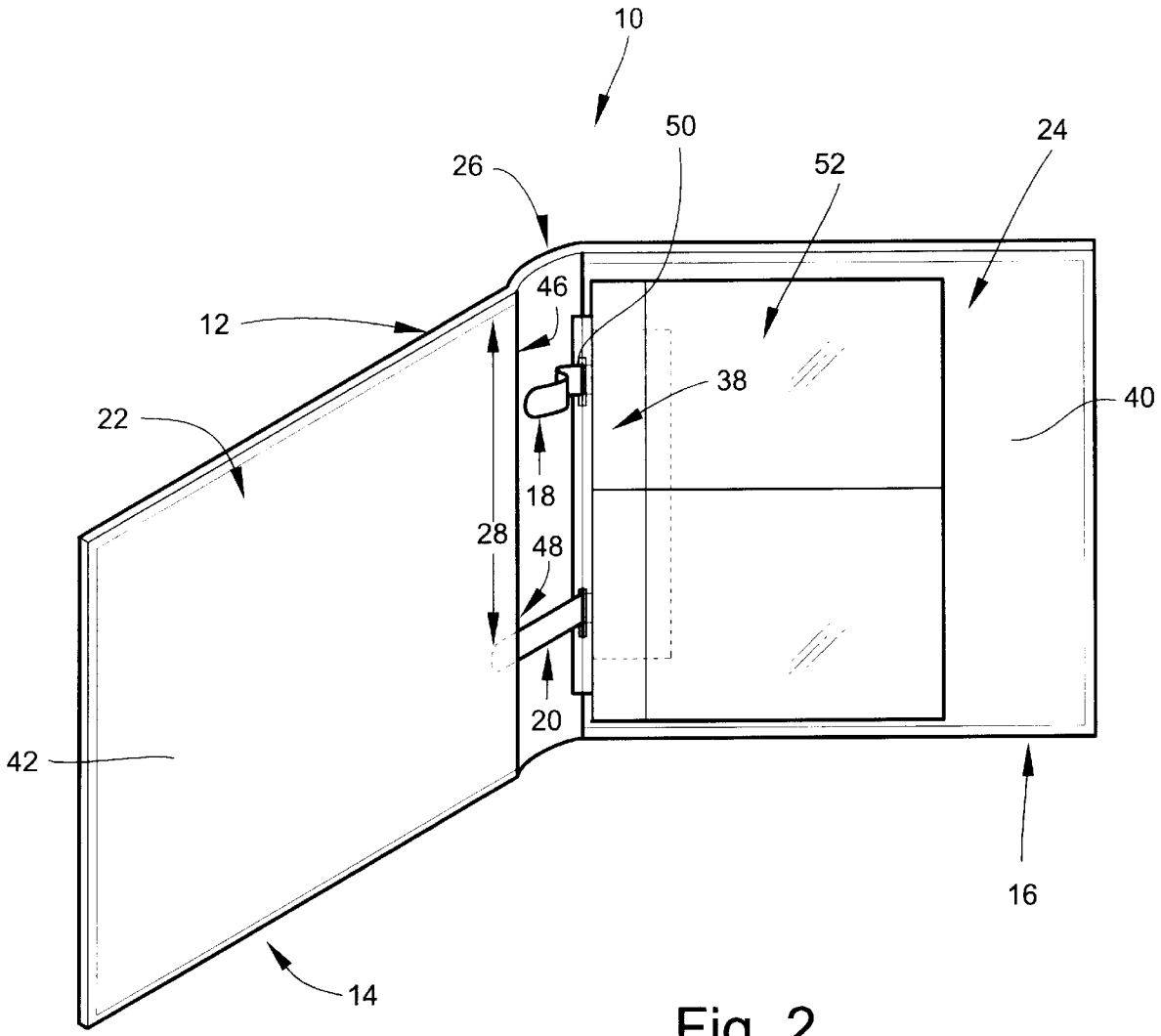
FIG. 2 is a perspective view of the album illustrated in FIG. 1 and showing the strap members holding an album page between the front and rear covers with the extending ends of the strap members being releasably secured to the front album cover and the anchored strap ends in phantom.

In the preferred embodiment, the strap members 18, 20 are positioned along the inner vertical extent 28 of the covers 14, 16 in a spaced apart position as shown in FIG. 1. The strap members 18, 20 may be positioned to accommodate preexisting openings in the album pages to be held in the album 12. While a pair of strap members is shown, the present invention may include multiple strap members, as needed or desired, for various applications. Each strap member 18, 20 has an anchored end 30, 32, respectively, which is fixedly secured to one of the covers and an opposite end 34, 36 extending away from the cover. In the preferred embodiment, the anchored ends 30, 32 of the strap members 18, 20 comprise a retaining strip 38 which extends vertically between and connects the strap members 18, 20. The retaining strip 38 is securely fastened along the vertical extent of the rear inside cover 24 and is preferably a plastic strip glued to the rear inside cover 24. As shown in FIGS. 1 and 2, a retaining sheet 40 is attached to the rear inside cover 24 and overlays the retaining strip 38 (shown in phantom) to securely fasten the anchored ends 30, 32 in place while also concealing the ends 30, 32 of the strap members 18, 20. In the preferred embodiment, the retaining sheet 40 substantially covers the entire rear inside cover 24, such as, by way of example, a liner board, to provide an aesthetically pleasing inside rear album cover.

Figure 3:
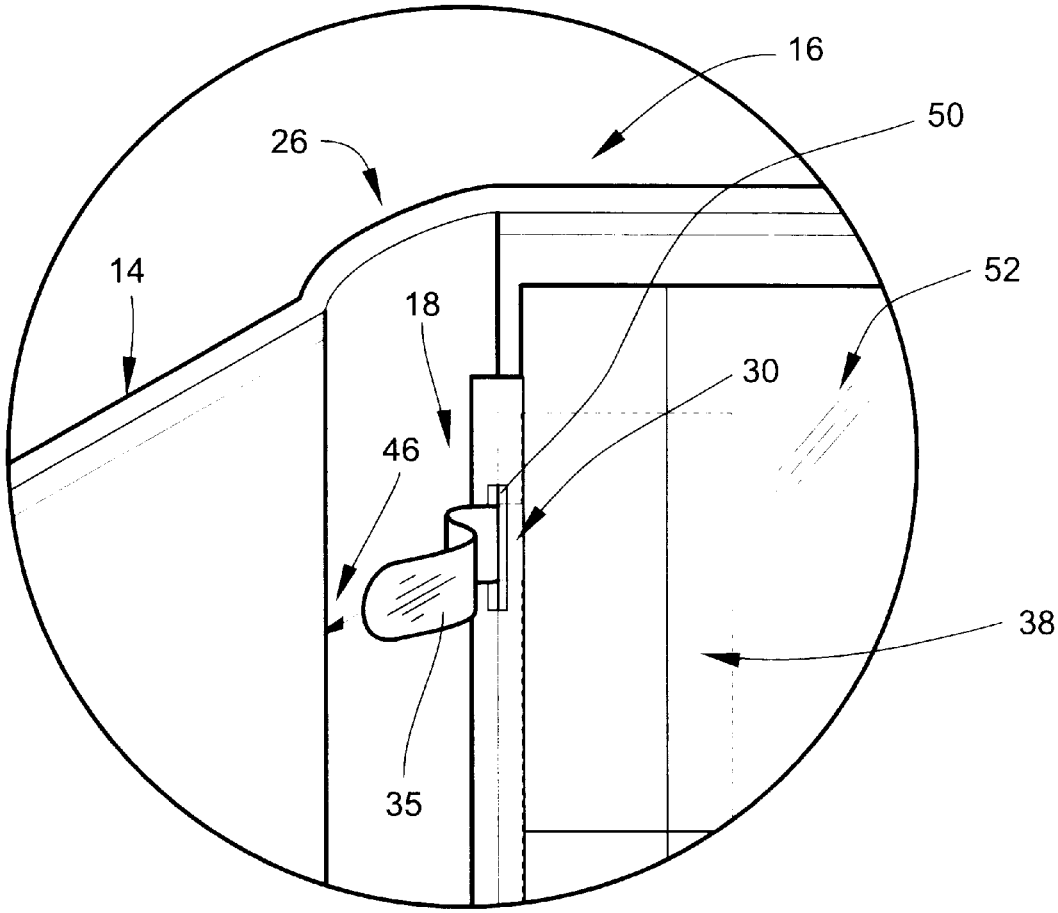
FIG. 3 is an enlarged detail view showing the extending end of a strap member being inserted into the pocket between the liner and the cover.

In the preferred embodiment, means for releasably securing the extending ends 34, 36 of the strap members 18, 20 to the inside front inside cover 22 include a retaining sheet 42 which is attached to the front inside cover 22 and forms a pocket 44 with the front inside cover. The retaining sheet 42 preferably substantially covers the entire inside front cover, such as, by way of example, a liner board, to provide an aesthetically pleasing inside front album cover. The pocket 44 includes an entry with entry portions 46, 48 positioned along the inner vertical extent 28 of the front inside cover 22 for receiving the ends 34, 36 of the strap members 18, 20. As best seen in FIG. 3, the extending ends 34, 36 of the strap members are inserted through openings 50 along the left margins of clear album pages 52 and then slide under the retaining sheet 42 into the entry portions 46, 48 of the pocket 44 to releasably secure the album pages 52 together within the covers 14, 16. As shown in FIG. 3, the extending ends 34, 36 of the strap members 18, 20 of the preferred embodiment are rounded and include a textured surface 35 for frictionally retaining the ends 34, 36 within the pocket 44 and securely hold the strap in place.

Figure 4:
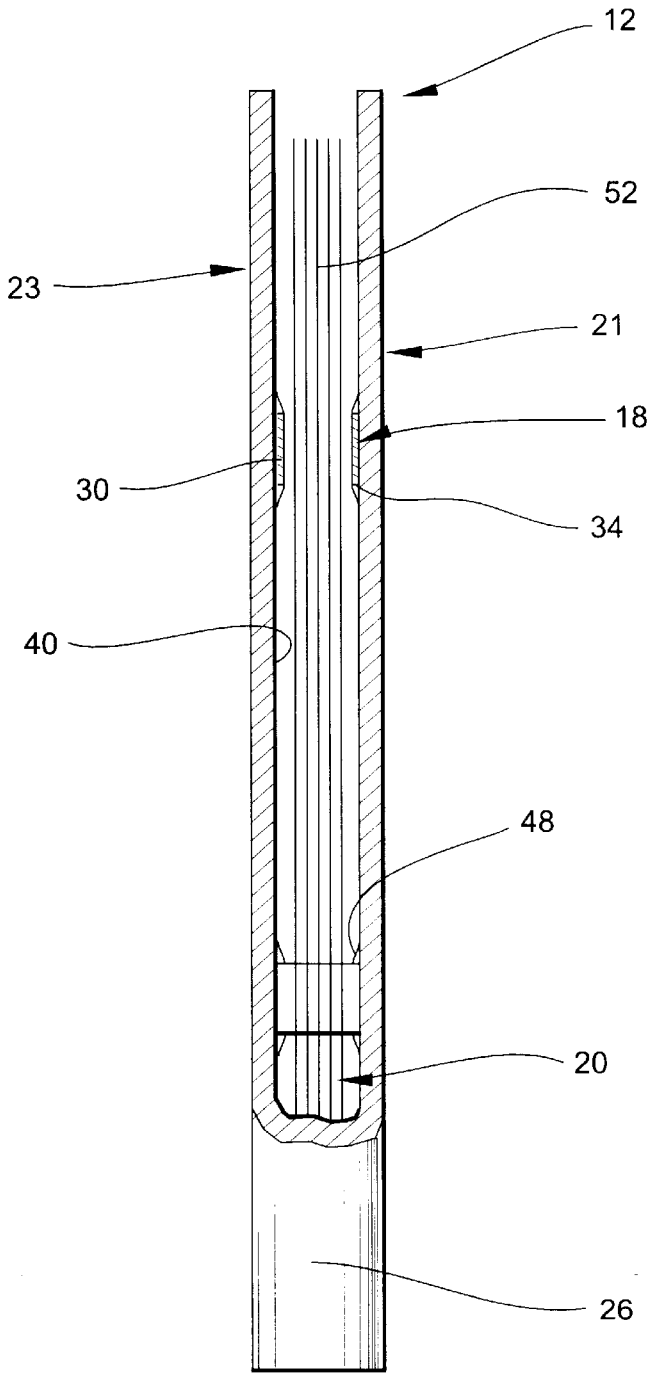
FIG. 4 is a view, partially broken away, of the spine end of the album in a closed, lay flat condition and showing the strap members extending between the covers to bind the pages together and also showing a partial cross sectional view of one strap member.

FIG. 4 illustrates a spine end view of the closed, lay flat album 12 after the album pages 52 have been secured therein. The partially broken away view of FIG. 4 illustrates the upper strap member 18 in a cross-section taken underneath the strap member 18 to show the anchored end 30 and the extending end 34 of the strap member 18. The lower strap member 20 is visible through the clear ends of the album pages 52 and is shown extending between the covers 14, 16 and across the spine 26 to releasably bind the pages 52 in a lay flat condition.

Figure 5:
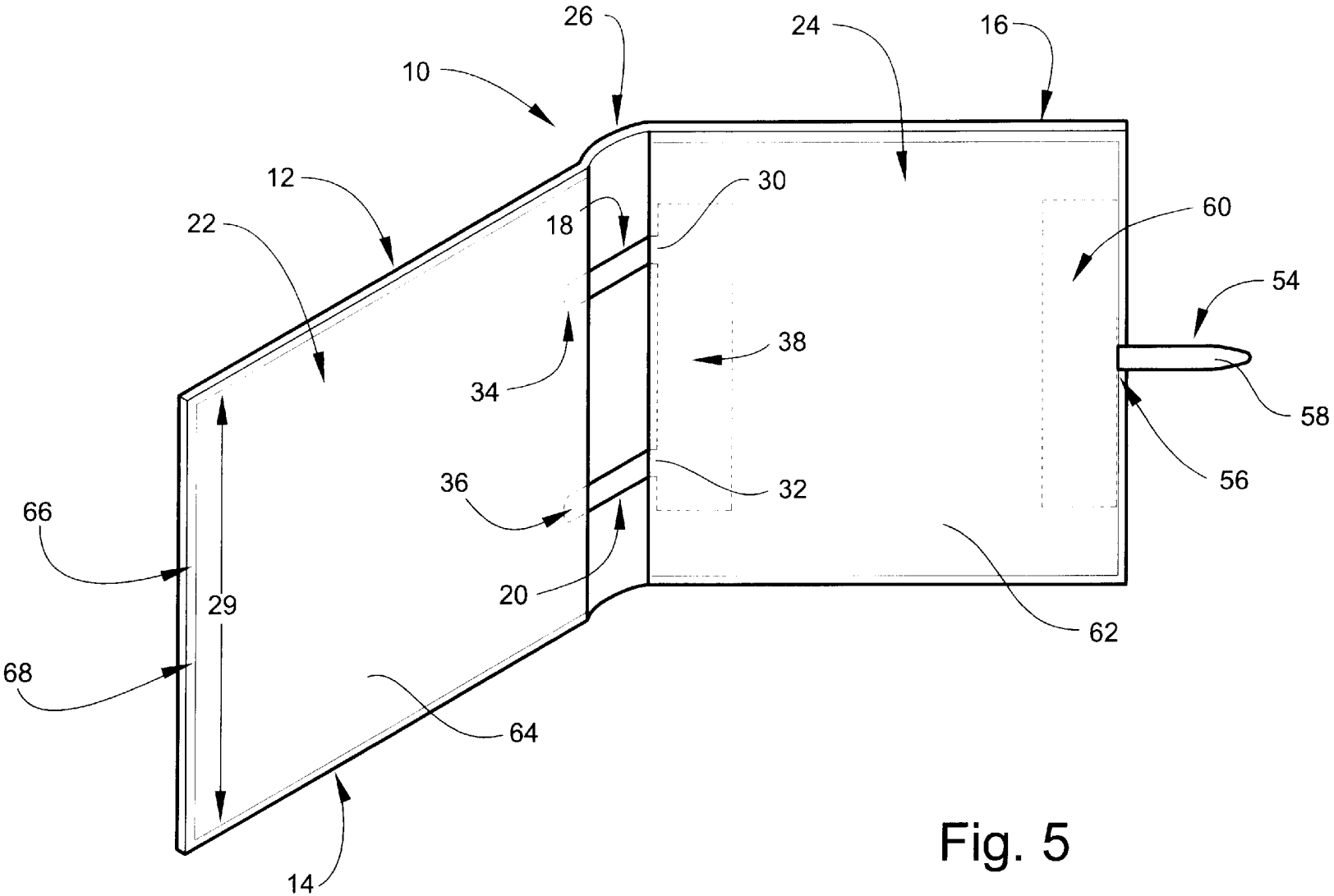
FIG. 5 is a perspective view of another embodiment of the present invention including a closure strap for releasably holding the album in a closed condition.

In an alternate embodiment of the present invention, the album 12 includes a closure strap 54 for releasably holding the album 12 in a closed, lay flat condition. The closure strap 54 includes one anchored end 56 which is permanently secured to one cover and an opposite extending end 58 which is releasably secured to the other cover. As shown in FIG. 5, in the alternate preferred embodiment, the anchored end 56 of the closure strap 54 comprises a retaining strip 60 (shown in phantom) which is adhered to the rear inside cover 24 near the outer vertical extent 29. While the preferred retaining strip 60 is plastic and is glued to the rear inside cover 24, the retaining strip may be constructed of any suitable material and attached to the cover by any suitable means. In the alternate preferred embodiment, a retaining sheet 62 is attached to the rear inside cover 24 and overlays the end 56 of the closure strap 54 to help hold it in place while also concealing the strap end 56. The retaining sheet 62 substantially covers the entire rear inside cover 24 and is preferably the same retaining sheet which overlays and secures the ends 30, 32 of the strap members 18, to the inner vertical extent of the rear inside cover 24. Thus, a single liner board may cover the entirety of the rear inside cover 24 and secure both the anchored end 56 of the closure strap 54 and the anchored ends 30, 32 of the strap members 18, 20.

Figure 6:
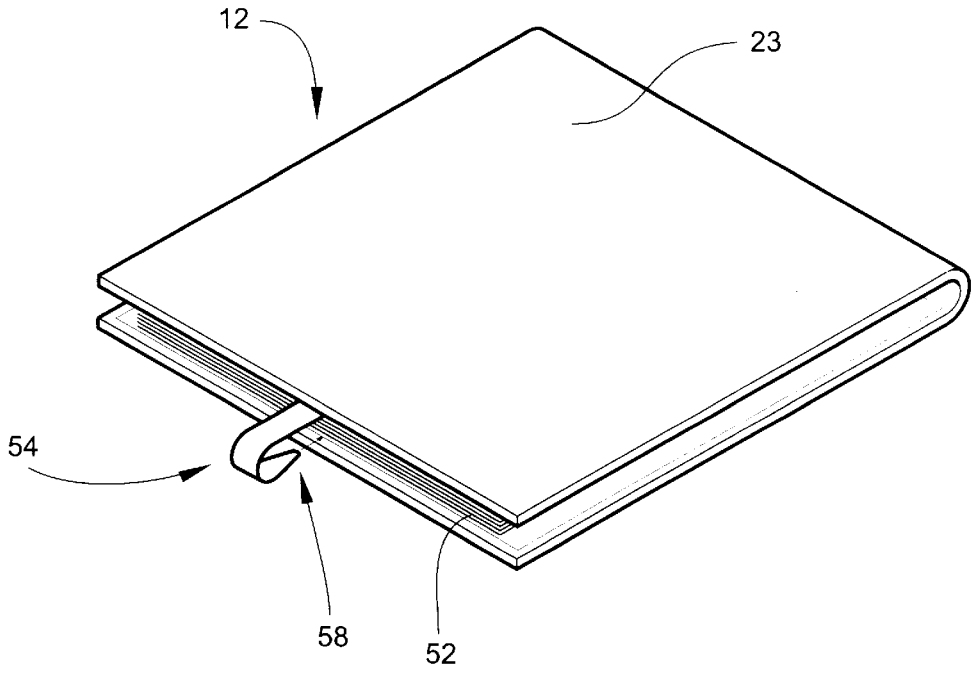
FIG. 6 is a perspective view of the album shown in FIG. 5 and including the closure strap and showing the non-anchored end of the closure strap in the process of being secured.
Figure 7:
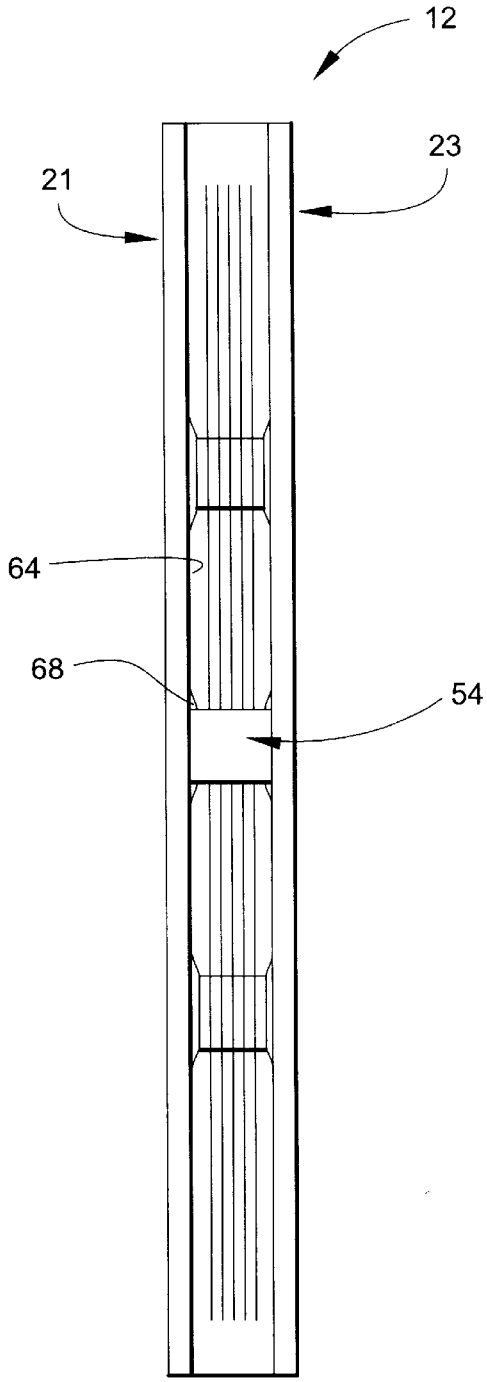
FIG. 7 is an end view of the album shown in FIG. 5 and showing the album in the closed, lay flat condition with the closure strap secured in place.

In the alternate preferred embodiment, the extending end 58 of the closure strap 54 is releasably secured to the front inside cover 22 by a retaining sheet 64. The preferred retaining sheet 64 substantially covers the entire front inside cover 22 and is the same retaining sheet which secures the extending ends 34, 36 of the binding strap members 18, 20. In the alternate preferred embodiment, the retaining sheet 58 forms a closure pocket 66 between the sheet and the front inside cover 22 having a pocket entry 68 positioned along the outer vertical extent of the front inside cover 22 for receiving the extending end 58 of the closure strap 54 and securing the album in a closed, lay flat condition as shown in FIGS. 6 and 7. In use, the user simply slides the strap end 58 into the pocket 66 to secure the strap 54 in place. FIG. 7 illustrates an end view of the album 12 with the closure strap 54 in place to secure the album 12 in the closed condition. Further, as best seen in FIG. 5, the extending end 58 of the closure strap 54 is tapered and may include a textured surface for frictionally retaining the closure strap end in the pocket 66 and providing an exceptionally secure closure.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A connection system for securing pages together having openings therein between covers in a lay flat condition, said connection system comprising:

a. a pair of cover pieces;

b. a strap having opposite ends, with one end being fixedly secured to one of said cover pieces and with the other end extending away from said one cover piece;

c. means attached to the other cover piece for releasably securing said extending end of said strap to the other of said cover pieces, wherein said means comprises a retaining sheet secured to said other cover piece; and d. wherein said strap is passed through said openings in said pages and then is releasably secured to said other cover piece.

2. The connection system of claim 1, wherein said retaining sheet forms a pocket between said other cover piece and said retaining sheet for receiving and retaining said one end of said strap therein and said extending end of said strap slides into said pocket.

3. A lay flat album of the type having releasably bound pages having openings therein, said album comprising:

a. a front cover and a rear cover;

b. a plurality of elongated, flexible strap members each having opposite ends, with one end being fixedly secured to said rear cover and with the other end extending away from said rear cover;

c. means attached to said front cover for releasably securing said extending ends to said front cover, wherein said means comprises a retaining sheet secured to said front cover and forming a pocket between said front cover and said retaining sheet for receiving and retaining said extending ends of said strap members therein and wherein said ends slide into said pocket; and d. wherein said strap members are passed through said openings of said pages and then are releasably secured to said front cover.

4. The album of claim 3, wherein said covers each include an inside and an outside and said retaining sheet substantially covers said front inside cover and said pocket includes an entry portion for slidably receiving said extending ends of said strap members.

5. The album of claim 4, wherein said extending ends of said strap members include a textured surface for frictionally retaining said strap within said pocket.

6. The album of claim 3, wherein said covers include an inside cover and an outside cover and each inside cover has an inner vertical extent and an outer vertical extent and said strap members are selectively positioned along the inner vertical extent of said covers and extend therebetween for releasably binding pages within said covers.

7. The album of claim 6, wherein said inner vertical extent of said front and rear covers are attached to a spine portion for joining said covers together whereby said front cover, rear cover and spine portion form one piece.

8. The album of claim 6, wherein said fixedly secured ends of said strap members comprise a retaining strip extending therefrom and between said strap members, said retaining strip being adhered to said inside rear cover.

9. The album of claim 8, further comprising a retaining sheet securely fastened to said rear cover for overlaying said retaining strip and concealing said fixedly secured ends of said strap members.

10. The album of claim 9, wherein said retaining sheet covers the entire rear inside cover.

11. The album of claim 3, wherein said plurality of strap members comprises two spaced apart strap members.

12. The album of claim 3, wherein said plurality of strap members comprises three spaced apart strap members.

13. A lay flat album of the type having releasably bound pages having openings therein, said album comprising:

a. a front cover and a rear cover, said covers including an inside cover and an outside cover;

b. a plurality of elongated, flexible strap members each having opposite ends, with one end being fixedly secured to said rear cover and with the other end extending away from said rear cover, said fixedly secured ends of said strap members comprising a retaining strip extending therefrom and between said strap members, said retaining strip being adhered to said inside rear cover;

c. means attached to said front cover for releasably securing said extending ends to said front cover;

d. a retaining sheet securely fastened to said rear cover for overlaying said retaining strip and concealing said fixedly secured ends of said strap members;

e. wherein said strap members are passed through said openings of said pages and then are releasably secured to said front cover; and f. wherein each inside cover has an inner vertical extent and an outer vertical extent and said strap members are selectively positioned along the inner vertical extent of said covers and extend therebetween for releasably binding pages within said covers.

14. The album of claim 13, wherein said retaining sheet covers the entire rear inside cover.

15. A connection system for securing pages together having openings therein between covers in a lay flat condition, said connection system comprising:

a. a pair of cover pieces, said cover pieces being joined together by an integral spine;

b. a strap having opposite ends, with one end being fixedly secured to one of said cover pieces and with the other end extending away from said one cover piece;

c. means attached to the other cover piece for releasably securing said extending end of said strap to the other of said cover pieces, wherein said means comprises a retaining sheet secured to one said cover piece and forming a pocket between said cover piece and said retaining sheet for receiving and retaining said extending ends of said strap members therein and wherein said ends slide into said pocket; and d. wherein said strap is passed through said openings in said pages and then is releasably secured to said other cover piece.

16. The album of claim 15, wherein said cover pieces each include an inside and an outside and said retaining sheet substantially covers said front inside cover and said pocket includes an entry portion for slidably receiving said extending ends of said strap members.

* * * * *